US011352973B2

(12) United States Patent
Lehman et al.

(10) Patent No.: US 11,352,973 B2
(45) Date of Patent: Jun. 7, 2022

(54) MACHINE SYSTEM AND OPERATING STRATEGY USING AUTO-POPULATION OF TRIM FILES

(71) Applicant: Caterpillar Inc., Deerfield, IL (US)

(72) Inventors: Martin Lehman, Congerville, IL (US); Vincent Neyens, Peoria, IL (US); Scott Shafer, Morton, IL (US); Andrew Marrack, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/374,860

(22) Filed: Apr. 4, 2019

(65) Prior Publication Data

US 2020/0318569 A1 Oct. 8, 2020

(51) Int. Cl.

| | |
|---|---|
| ***F02D 41/24*** | (2006.01) |
| ***F02D 41/40*** | (2006.01) |
| ***F02M 65/00*** | (2006.01) |

(52) U.S. Cl.

CPC ..... *F02D 41/2467* (2013.01); *F02D 41/2432* (2013.01); *F02D 41/402* (2013.01); *F02M 65/002* (2013.01)

(58) Field of Classification Search

CPC .. F02D 41/24; F02D 41/2432; F02D 41/2435; F02D 41/2467; F02D 41/402; F02M 65/00; F02M 65/002

USPC ..... 701/101–105, 114, 115

See application file for complete search history.

(56) References Cited

U.S. PATENT DOCUMENTS

| | | | | |
|---|---|---|---|---|
| 5,575,264 | A | 11/1996 | Barron | |
| 5,634,448 | A * | 6/1997 | Shinogle | F02D 41/2435 123/478 |
| 5,839,420 | A * | 11/1998 | Thomas | F02D 41/2435 123/478 |
| 6,588,398 | B1 | 7/2003 | Rodier | |
| 7,093,586 | B2 * | 8/2006 | Mattes | F02D 41/40 123/478 |
| 7,136,743 | B2 | 11/2006 | Peltier | |
| 7,637,253 | B2 * | 12/2009 | Remele | F02D 41/20 123/480 |
| 8,886,858 | B2 | 11/2014 | Alsford et al. | |
| 2003/0041658 | A1 * | 3/2003 | Leman | F02D 41/2467 73/114.47 |

(Continued)

FOREIGN PATENT DOCUMENTS

| | | | |
|---|---|---|---|
| DE | 10117809 | A1 | 10/2002 |
| EP | 864038 | A1 | 9/1998 |

*Primary Examiner* — John Kwon
*Assistant Examiner* — Johnny H Hoang
(74) *Attorney, Agent, or Firm* — Brannon Sowers & Cracraft

(57) ABSTRACT

Operating a machine system includes triggering, based on activation of an on-board electronic control system, interrogation of electronically controlled components installed in a machine to read a plurality of electronic trim files each resident on a different one of the electronically controlled components. A data structure on an electronic storage medium in the control system is populated with the electronic trim files each time the control system is activated, such as by turning on an ignition switch. Operating the machine system also includes outputting control signals based on the electronic trim files to run the machine system based on operation of the electronically controlled components responsive to the outputted control signals.

18 Claims, 4 Drawing Sheets

(56) References Cited

U.S. PATENT DOCUMENTS

| | | | | |
|---|---|---|---|---|
| 2003/0041843 | A1* | 3/2003 | Shinogle | F02D 41/2467<br>123/486 |
| 2003/0200957 | A1* | 10/2003 | Shinogle | F02M 65/002<br>123/480 |
| 2012/0035833 | A1* | 2/2012 | Melis | F02D 41/401<br>701/104 |
| 2013/0024098 | A1* | 1/2013 | Li | F02D 41/2441<br>701/104 |
| 2013/0090838 | A1* | 4/2013 | Jade | F02D 35/028<br>701/104 |
| 2016/0017832 | A1* | 1/2016 | Touchette | F02D 41/2467<br>701/104 |

* cited by examiner

MACHINE SYSTEM AND OPERATING STRATEGY USING AUTO-POPULATION OF TRIM FILES

TECHNICAL FIELD

The present disclosure relates generally to systems and strategies for trimming electronically controlled components in a machine system, and more particularly to automatically updating electronic trim files in a machine system each time a machine control system is activated, using electronic trim files resident on the electronically controlled components.

BACKGROUND

Internal combustion engines are a well-known type of machine system widely used for more than a century. In a typical design, a fuel is combusted with air in a cylinder to produce a rapid rise in pressure and temperature that drives a piston to rotate a crankshaft. The power output of the engine can be used in virtually innumerable ways, such as providing rotational power for vehicle propulsion, rotating parts in an electrical generator to generate electrical power, pressurizing or transferring liquids or gases, and many others. As the design and sophistication of internal combustion engines has continued to advance, engineers demand ever-improving performance and reliability from internal combustion engine components.

In recent decades certain emissions regulations for engines have become increasingly stringent. Engineers have looked to fuel systems, among other engine systems, for precise electronic control to enable or support engine operation in a way that allows production of certain emissions to be limited. For example, in a direct injected compression ignition engine it has been discovered that relatively precise fuel injection timing, duration, amount, and so-called rate shape can assist in achieving not only a desired emissions profile of the engine but also relatively high fuel efficiency in many instances. The precise control required to implement these and many other strategies can require relatively fast-moving internal components, rapid energizing and deenergizing of electrical actuators, and tight mechanical tolerances. Certain ostensibly identical machine system components, notably but not exclusively electronically controlled fuel injectors, can function slightly differently in service even when subjected to and controlled according to nominally identical conditions. For example, different operational and performance results can be observed in fuel injectors responsive to the same control signal waveform Fuel injectors and other machine system components can be electronically trimmed to obtain desired operation and performance. In one strategy, fuel injectors are tested under relatively tightly controlled conditions at the factory, and electronic trim files produced that can be used to enable an electronic control unit to obtain the desired outcomes when the fuel injectors are placed in service. A known problem with such an approach is that human error in obtaining or loading trim files can lead to one or more fuel injectors being associated with an incorrect trim file. One automated electronic trim strategy for a fuel injector is known from U.S. Pat. No. 6,588,398 to Rodier.

SUMMARY OF THE INVENTION

In one aspect, a method of operating a machine system includes activating an on-board electronic control system of a machine, and triggering, based on the activating of the on-board electronic control system, interrogation of a plurality of electronically controlled components installed in the machine by a computer of the on-board electronic control system. The method further includes reading, during the interrogation, a plurality of electronic trim files each resident on a different one of the plurality of electronically controlled components. The method further includes populating a data structure on a machine readable storage medium in the on-board electronic control system with the plurality of electronic trim files, and outputting control signals each based on the corresponding one of the plurality of electronic trim files to each of the plurality of electronically controlled components. The method still further includes running the machine system after the populating of the data structure based on operation of the plurality of electronically controlled components responsive to the outputted control signals.

In another aspect, a machine system includes at least one computer having a processor and a machine readable controller storage medium storing a data structure. The machine system further includes a plurality of electronically controlled components structured for installation in a machine and each including a machine readable component storage medium storing a unique component identifier and a unique electronic trim file. The machine system further includes a communication link connecting the at least one computer and the plurality of electronically controlled components. The at least one computer is structured to detect activation of the on-board electronic control system in the machine, and trigger, based on detecting the activation of the on-board electronic control system, interrogation of the plurality of electronically controlled components. The at least one computer is further structured to read, during the interrogation, each of the unique component identifiers and unique electronic trim files from the machine readable component storage mediums of the plurality of electronically controlled components, and to populate the data structure with the unique component identifier and the unique electronic trim file of each of the plurality of electronically controlled components. The at least one computer is still further structured to output control signals each based on the corresponding unique electronic trim file to each of the plurality of electronically controlled components, and to run the machine system based on operation of the plurality of electronically controlled components responsive to the outputted control signals.

In still another aspect, a method of reducing servicing errors in a machine system includes deactivating an electronic control system of a machine, and activating the electronic control system. The method further includes triggering, based on the activating of the electronic control system, interrogation of a plurality of electronically controlled components installed in the machine by a computer of the electronic control system, and machine reading, during the interrogation, a plurality of electronic trim files each resident on a different one of the plurality of electronically controlled components. The method further includes populating a data structure on a machine readable storage medium in the electronic control system with the plurality of electronic trim files, and overwriting, by way of the populating of the data structure, a plurality of previously stored electronic trim files mis-matched to the plurality of electronically controlled components. The method still further includes outputting control signals based on the corresponding electronic trim file to each of the plurality of electronically controlled components, and operating the plurality of electronically controlled components responsive to the outputted control signals.

DETAILED DESCRIPTION

Figure 1:
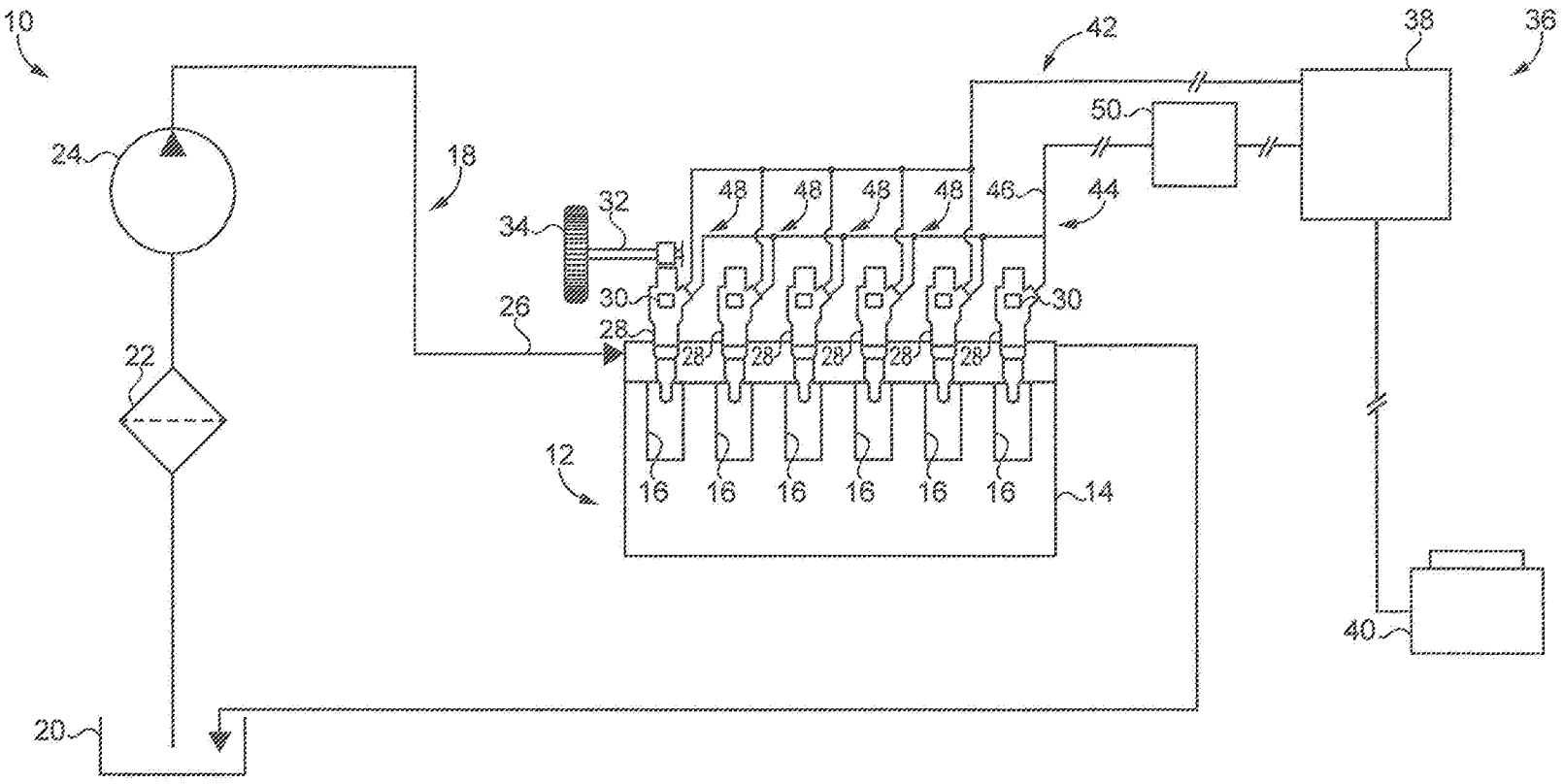
FIG. 1 is a diagrammatic view of a machine system, according to one embodiment.

Referring to FIG. 1, there is shown a machine system 10 according to one embodiment and including a machine 12. Machine 12 may include or be an internal combustion engine, such as a direct injection compression ignition internal combustion engine. Machine system 10 might be an off-highway vehicle machine system, a power generation machine system, a compressor, a pump, or a great many other types of machine systems. Machine 12 (hereinafter "engine 12") includes an engine housing 14 having a plurality of combustion cylinders 16 formed therein. Cylinders 16 can include any number of cylinders, in any suitable arrangement.

Machine system 10 also includes a fuel system 18 having a fuel supply or tank 20, a fuel pump 24, and a filter 22 positioned fluidly between fuel supply 20 and fuel pump 24. Fuel system 18 further includes a fuel conduit 26 for conveying a fuel, such as a liquid diesel distillate fuel, to engine housing 14. Fuel system 18 may convey fuel for injection into cylinders 16 by way of a plurality of fuel injectors 28 each positioned to extend into one of cylinders 16. In the illustrated embodiment fuel system 18 supplies fuel for pressurization within fuel injectors 28 as further discussed herein. Fuel injectors 28 may be mechanically actuated, such as by way of a camshaft 32 coupled with a cam gear 34 in a generally conventional manner. In other instances, fuel injectors 28 could be hydraulically actuated, with fuel system 18 supplying pressurized fuel for actuating internal components within fuel injectors 28. The actuating fluid could be a fluid different from fuel in other instances, such as engine oil. Fuel injectors 28 are but one type of electronically controlled component to which the present disclosure is applicable, as will be further apparent from the following description. A plurality of the electronically controlled components, in the illustrated case fuel injectors 28, may be structured for interchangeable service in machine system 10. The term "fuel injector" is used interchangeably herein with "electronically controlled component" except where otherwise indicated. Those skilled in the art will appreciate that fuel injectors can be swapped among different, but interchangeable service locations in engine 12. Each of fuel injectors 28 may be controlled, however, by way of electronic trimming in a unique manner relative to the other fuel injectors 28, each with a unique and dedicated electronic trim file established under controlled, consistent, and repeatable conditions such as at the factory. In other instances, electronic trim files could be established in-chassis.

Machine system 10 further includes an on-board electronic control system 36. Control system 36 includes at least one computer for monitoring and controlling any of a variety of different electronically controlled components of machine system 10, including fuel injectors 28. The at least one computer can include an electronic control unit or engine control unit 38 in control signal communication with fuel injectors 28 by way of a control link 42, such as a conventional wiring harness. Control system 36 may also include a communication link 44, such as a single-wire communication link or other wired communication link having a plurality of nodes 48 corresponding to the plurality of different interchangeable service locations. In the illustrated embodiment the plurality of different interchangeable service locations are cylinder locations each occupied by one of fuel injectors 28.

Control system 36 can further include a communication control unit 50 structured by way of software, firmware, or hardware, to manage and relay certain electronic communications between fuel injectors 28 and electronic control unit 38. In a practical implementation strategy, communication control unit 50 can include a dedicated computer processor preconfigured to gather data from each of fuel injectors 28 by way of interrogating fuel injectors 28 as further discussed herein. Control system 36 also includes an activation switch or button 40 that is actuated to activate and/or deactivate control system 36. In an implementation, switch 40 can include a start-stop button or an ignition switch in machine system 10. Each of fuel injectors 28 further includes a machine readable component storage medium 30 resident thereon. Storage mediums 30 can be or include a computer memory storage chip storing a unique component identifier for each fuel injector 28, such as a component number or a serial number. Storage mediums 30 may further store one or more unique electronic trim files for the corresponding fuel injector 28. In other embodiments, electronically controlled components other than fuel injectors could analogously be equipped with a resident machine readable component storage medium storing a unique component identifier and one or more unique electronic trim files consistent with the functional purposes of the electronically controlled component. In still further instances, the unique electronic trim file stored on each component storage medium 30 can include one of a plurality of electronic trim files, including a first electronic trim file for operating the corresponding one of fuel injectors 28 at a first set of operating conditions of machine system 10, a second electronic trim file for operating the corresponding fuel injector 28 at a second set of operating conditions of machine system 10, and potentially additional trim files. For example, a first electronic trim file could be provided for operating the corresponding fuel injector 28 at a low altitude, such as sea level or up to some altitude threshold, and a second electronic trim file for operating machine system 10 at another altitude, above the predetermined altitude threshold. A great many different sets of conditions could be experienced by machine system 10, and a great many different electronic trim files could be resident on each fuel injector 28 for electronic trimming in a desired manner depending upon present machine system operating conditions.

Figure 2:
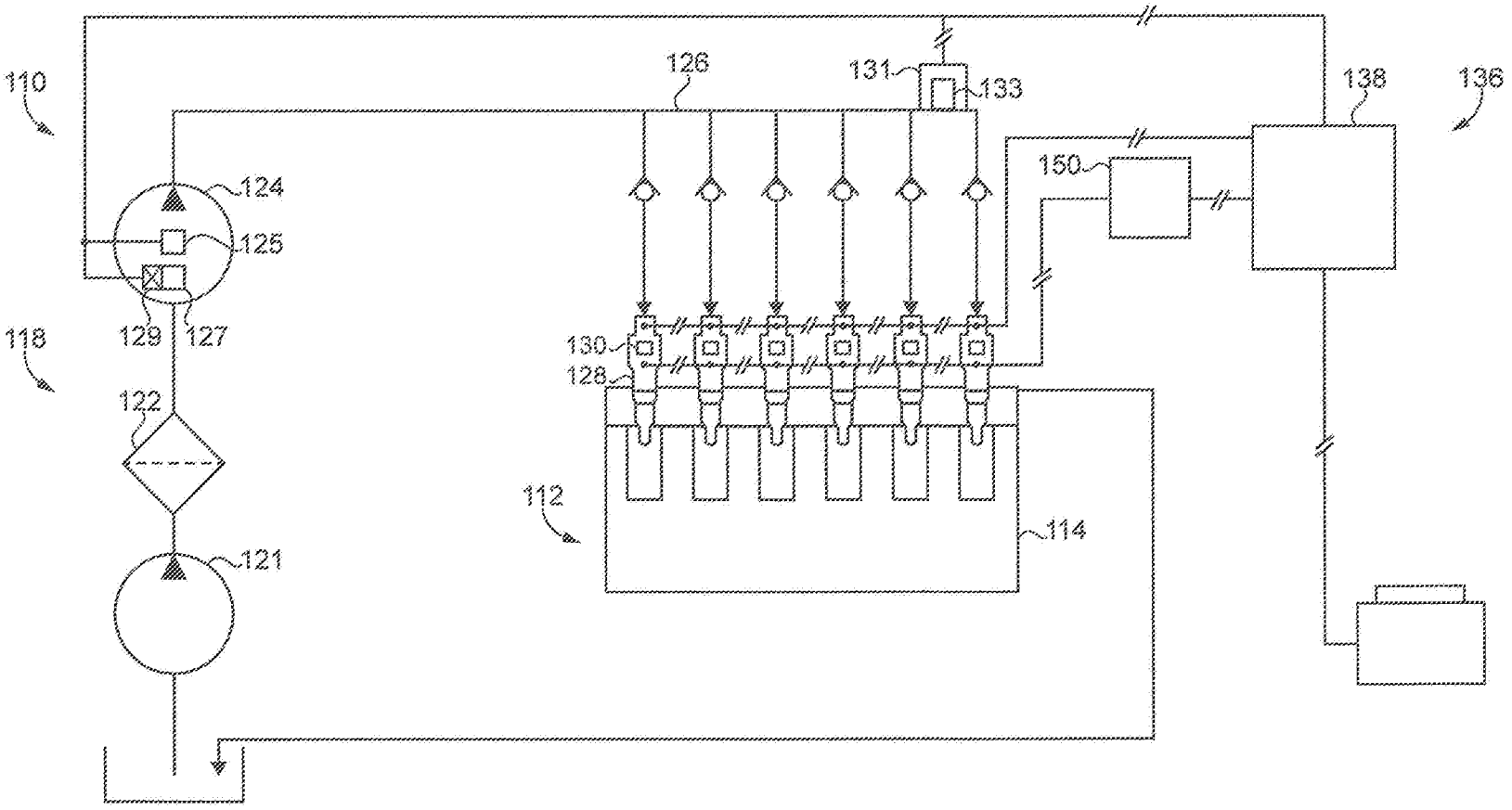
FIG. 2 is a diagrammatic view of a machine system, according to another embodiment.

Referring now to FIG. 2, there is shown another machine system 110 having a number of similarities with machine system 10 of FIG. 1, but certain differences. Machine system 110 can likewise include an internal combustion engine system having a machine 112 that is or includes an internal combustion engine, having an engine housing 114. Machine system 110 also includes a control system 136 having at least one computer, in the illustrated case an electronic control unit or engine control unit 138, and a communication control unit 150. Control system 136 could be structured with a conventional wiring harness for controlling operation of a plurality of fuel injectors 128, and a single-wire communication link for communicating with fuel injectors 128 for electronic trim purposes as further discussed herein. Machine system 110 also includes a fuel system 118 having a fuel transfer pump 121, a filter 122, and an electronically controlled high pressure pump 124. High pressure pump 124 can pressurize fuel to a pressure suitable for injection and convey the fuel to a common rail 126 structured to simultaneously feed pressurized fuel to fuel injectors 128 in a generally known manner. Each of fuel injectors 128 can include a machine readable storage medium 130 resident thereon that stores a unique component identifier and at least one unique electronic trim file generally analogous to the foregoing description of machine system 10. Machine system 110, in particular fuel system 118, can also include apparatus for controlling high pressure pump 124 including a valve 127 and an electrical valve actuator 129. Valve 127 could include an inlet-metering valve, whose position is adjusted by way of electrical actuator 129 to inlet-meter high pressure pump 124 in a manner that controls or assists in controlling a pressure of fuel within common rail 126. High pressure pump 124 can also include a machine readable storage medium 125 that stores a unique component identifier for high pressure pump 124 and at least one unique electronic trim file for high pressure pump 124. Fuel system 118 can also include a pressure sensor 131 that is operably coupled with common rail 126 and structured to output a pressure signal indicative of a pressure of fuel within common rail 126. Pressure sensor 131 can include a machine readable storage medium 133 that stores a unique component identifier and at least one electronic trim file for pressure sensor 131, such as a trim file for linearizing a non-linear output of pressure sensor 131.

As discussed above a variety of different electronically controlled components are contemplated within the context of the present disclosure. Electronic trimming of electronically controlled components such as fuel injectors, pumps, valves, sprayers, electrical or hydraulic actuators, and many others enables a class of nominally identical components, or an individual component, to behave in a desired and generally consistent manner. In systems where electronic trimming is not used, or is inferior or faulted, a plurality of electronically controlled components might all receive the same control signal such as an electronic control signal waveform, but each respond differently based on a "personality" unique to each individual electronically controlled component. In the case of fuel injectors, an electronic control unit such as electronic control unit 38 can look up control signals such as signal amplitudes, signal timings, signal durations, or other signal characteristics, from a multidimensional map that is populated on the basis of either or both of empirical data or theoretical determinations as to how a given electronically controlled component can be expected to respond. Given the different personalities of the different electronic components, an electronic trim file may be used for each electronically controlled component to enable the control signal to be modified, adjusted, forgone, supplemented, tweaked, et. cetera, to produce the desired outcomes. Electronic trim files used in association with fuel injectors, for instance, could include an offset value, a multiplier, or some other numerical value that allows a map-derived or otherwise determined control signal to be customized for the fuel injector for which it is intended. Different but generally analogous electronic trimming techniques can be used with pumps, certain actuators, valves, sensors, and other electronically controlled components.

Each time a machine system is serviced, some components might have their service locations switched with one another, intentionally or incidentally. Electronically controlled components that appear to need replacement or upgrading can be swapped out for substitute electronically controlled components. A typical example is when an internal combustion engine system is tom down for a top-end overhaul, or less extensively serviced for other purposes, and some or all of its fuel injectors pulled out, cleaned, inspected, and replaced as needed. Some of the fuel injectors might be put back into different service locations. Other fuel injectors might be discarded or idled, and replaced with substitute fuel injectors. In earlier systems a control system commonly stored electronic trim files on the engine control unit or an associated control unit itself, with electronic trim files stored in the system in a way that associated the electronic trim files with specific service locations in the machine system. In other words, an engine control system might store electronic trim files for numerous fuel injectors at addresses in computer memory that correspond to individual cylinder locations. When fuel injectors are rearranged with other fuel injectors within the same set, or substituted with substitute fuel injectors, a mis-match can occur between electronic trim files and the service locations of the fuel injectors. For example, if cylinder 1 had fuel injector 1 prior to service, but cylinder 1 then has fuel injector 2 after service, the fuel injector 2 at the cylinder 1 location could be expected to operate sub-optimally because it would receive control signals based on a mis-matched electronic trim file. Certain techniques have sought to obtain electronic trim files by querying a remote database or the like, and downloading all of the trim files for a set of fuel injectors. Such strategies suffer, however, from the possibility of not only human error but further changes to service locations or fuel injector identity being made after the download, or connectivity problems with a remote database, for instance. As will be further apparent from the following description, the present disclosure addresses these and other concerns.

Figure 3:
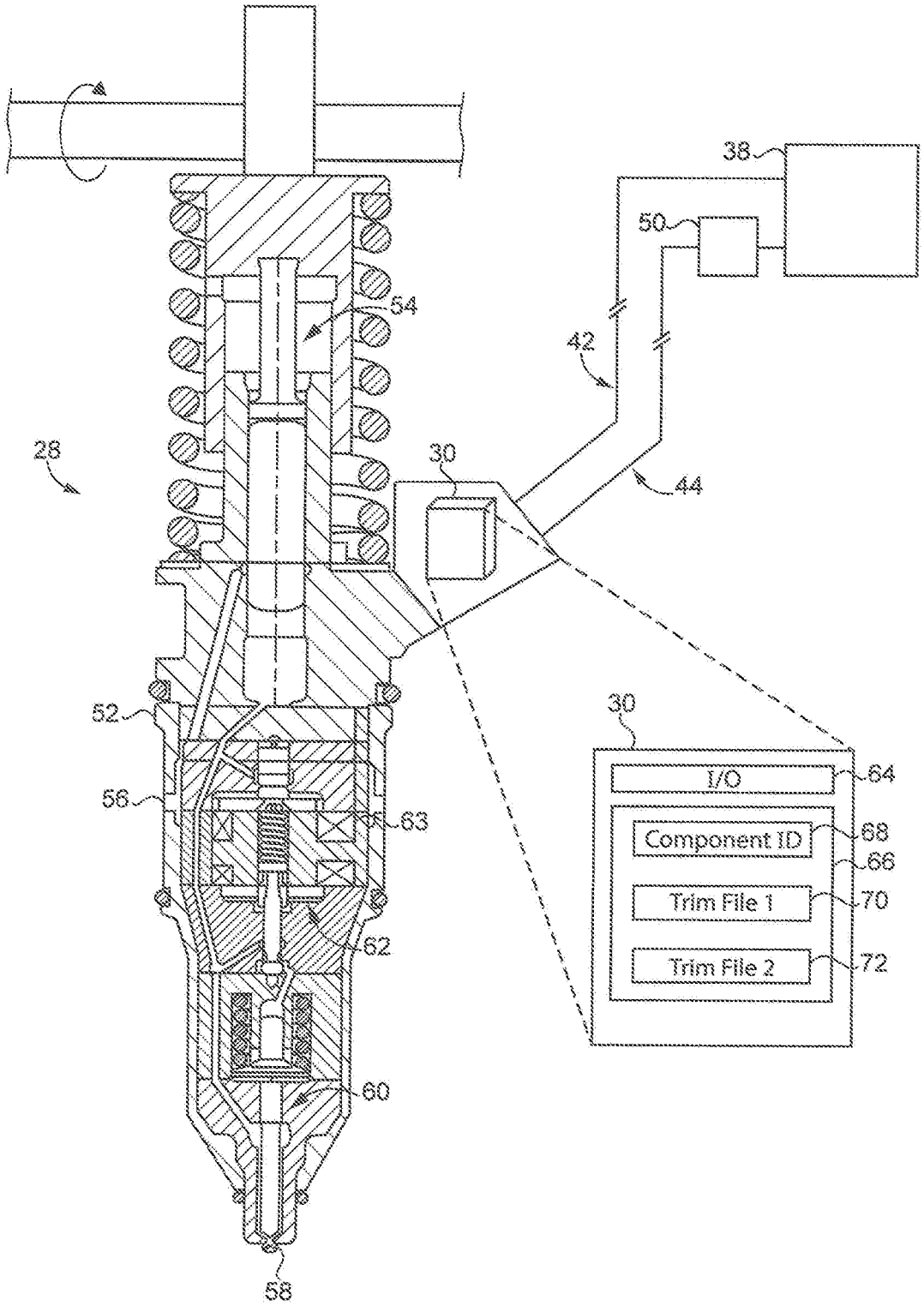
FIG. 3 is a diagrammatic view of a part of the machine system of FIG. 1, including a fuel injector and structure of a machine readable storage medium resident thereon.

Referring to FIG. 3, there is shown one of fuel injectors 28 in some additional detail. It should be appreciated that discussion herein of any one component in the singular, such as one of fuel injectors 28, should be understood to refer by way of analogy to other like components, except where otherwise indicated or apparent from the context. Likewise, discussion of any one embodiment should be understood to refer by way of analogy to any other embodiments except where otherwise indicated or apparent from the context. Fuel injector 28 includes an injector body 52 having a fuel inlet 56 formed therein, which can fluidly connect to fuel conduit 26, one or more nozzle outlets 58, and a fuel pressurization mechanism 54 positioned fluidly between fuel inlet 56 and nozzle outlet 58. Fuel pressurization mechanism 54 includes a cam-actuated plunger mechanism as will be familiar to those skilled in the art. As discussed above, rather than cam-actuation, hydraulic actuation could be used. As also noted, rather than a fuel injector in the nature of a unit pump such as fuel injector 28, in other embodiments a common rail can be used, or another fuel pressurization mechanism altogether. Fuel injector 28 also includes a hydraulically actuated outlet check assembly 60 coupled with an electronically actuated control valve assembly 62. Control valve assembly 62 includes an electrical actuator 63, such as a solenoid, that is controlled by way of control signals produced by electronic control unit 38. Fuel injectors 128 in the embodiment of FIG. 2 may include electronically controlled injection control valve assemblies, each equipped with an electrical actuator such as a solenoid. The control signals for fuel injector 28 can be determined by way of electronic trimming as discussed herein. Electronic trimming could include varying the timing, amplitude, or manner of energizing or de-energizing electrical actuator 63 from what might be otherwise obtained without electronic trimming. Also shown in an enlargement in FIG. 3 are certain attributes of machine readable storage medium 30 resident on fuel injector 28. Storage medium 30 can include an input/output interface 64, such as appropriate electrical connections for connecting with communication link 44, and a memory 66 that electronically stores the unique component identifier 68, a first electronic trim file at 70, and a second electronic trim file at 72. Memory 66 could be any suitable computer readable memory, such as flash memory, although alternatives such as DRAM, SDRAM, or others such as a hard drive in certain machine systems are not excluded.

Figure 4:
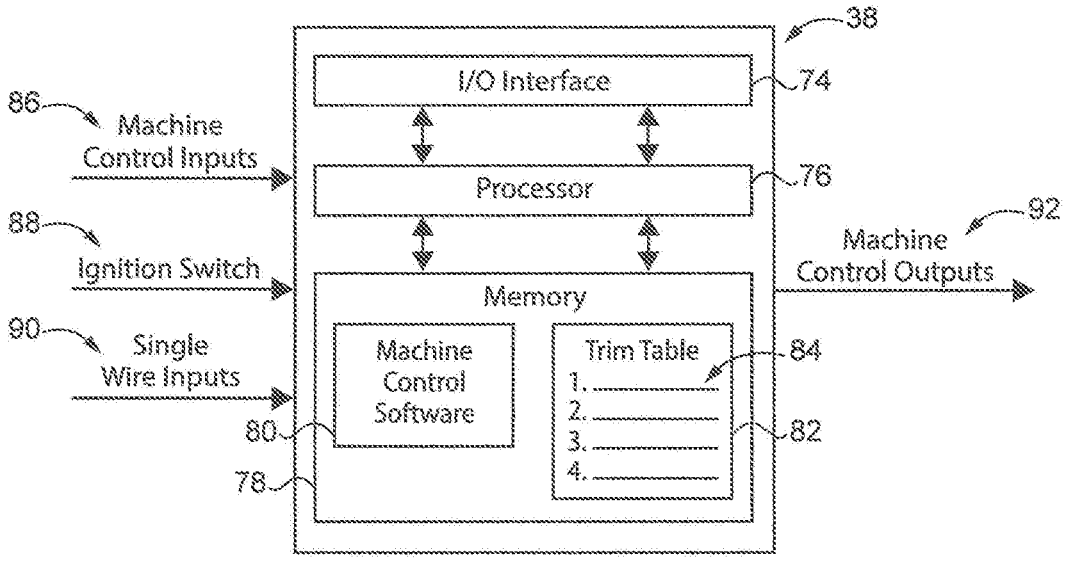
FIG. 4 is a diagrammatic view of structure and control aspects of a computer, according to one embodiment.

Referring also now to FIG. 4, there are shown additional features of electronic control unit 38, and illustrating machine control inputs at 86, an ignition switch or electronic control system state signal at 88, and single-wire inputs at 90. Machine control inputs 86 can include any input command from an operator or an electronic control for varying, initiating, or ceasing any operation of machine system 10, as well as data from any monitored machine operating parameter. Ignition switch input 88 can include an input signal indicating that ignition switch 40 has been actuated from an off position to an on position, or from an on position to an off position, to activate or deactivate, respectively, control system 36. Single-wire inputs 90 could include inputs encoding the unique component identifier and the unique electronic trim file for each of fuel injectors 28 in a manner and sequence determined by communication control unit 50. Also depicted in FIG. 4 are machine control outputs 92 which can include control signals for fuel injectors 28 or for any of the other electronically controlled components of machine system 10. Electronic control unit 38 can also include an input/output interface 74, and a processor 76. Processor 76 can include any suitable central processing unit such as a microprocessor, a microcontroller, or potentially a field programmable gate array. Electronic control unit 38 also includes a machine readable controller storage medium, such as a computer readable memory 78, storing machine control software 80 that is used in controlling any of a great many different functions of machine system 10, and a trim table 82. Trim table 82 is one form of a data structure that can be electronically stored on memory 78. Trim table 82 can include a plurality of addresses 84. Addresses 84 could include a plurality of addresses each corresponding to a different one of a plurality of interchangeable service locations, namely cylinders 16, in engine 12 in machine system 10. It will therefore be appreciated that a predetermined address on memory 82, or another machine readable storage medium such as a memory associated with a different computer in machine system 10, can correspond to one cylinder in machine system 10. It will be recalled that fuel injectors may be switched between service locations, or swapped out for other fuel injectors. Processor 76, during execution of machine control software 80, may look up an electronic trim value for each fuel injector based on an address 84 in trim table 82 that is associated with the cylinder with which the corresponding fuel injector 28 is associated. It will be recalled that electronic trim files and unique identifiers may be transmitted by way of communication link 44 each time machine system 10 is turned on. Accordingly, even where electronically controlled components are switched among service locations, swapped out for other electronically controlled components or an unforeseen error occurs, the appropriate trim file will be stored in the appropriate location in trim table 82 when machine system operation commences, as further discussed herein. Control system 36 could also be structured to determine or set a unique tracking bit in certain instances by comparing a prior stored component identifier with a newly stored component identifier, thereby determining if an injector (or other electronically controlled component) has been swapped out for a substitute, or had its service location changed. In such instances, control system 36 could also attach an hour meter value to this event as a diagnostic, enabling service hours to be tracked at given service locations, and/or simply logging the timing of the event in the present service interval of the associated machine system.

INDUSTRIAL APPLICABILITY

Figure 5:
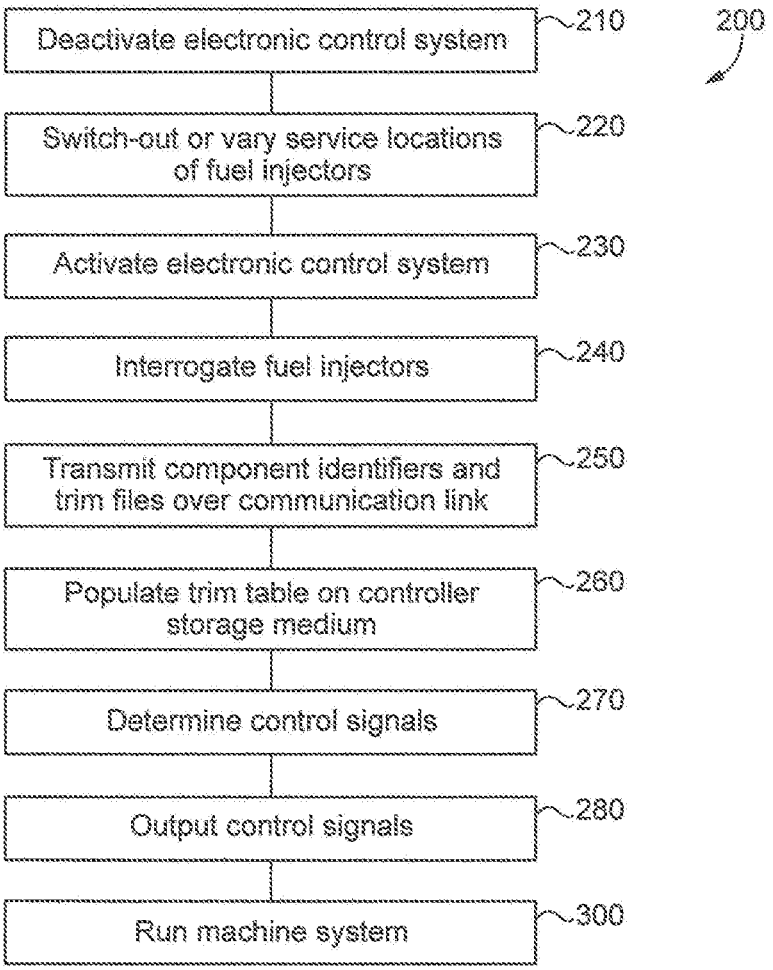
FIG. 5 is a flowchart illustrating example process and control logic flow, according to one embodiment.

Referring also now to FIG. 5, there is shown a flowchart 200 illustrating example process and control logic flow according to one embodiment. Flowchart 200 includes a block 210 where electronic control system 36 is deactivated, such as by turning off machine system 10 by actuating ignition switch 40 or turning an ignition key to an OFF position. It will be recalled that electronic control unit 38 receives ignition switch input 88 to detect activation of control system 36. Deactivating electronic control system 36 can be followed by inspection, testing, and/or switching out or varying service locations of electronically controlled components in machine system 10, such as fuel injectors 28, at a block 220. After servicing, or where machine system 10 is merely shut down routinely without any servicing, electronic control system 36 may be activated at a block 230, such as by actuating ignition switch 30 or turning an ignition key to an ON position. Activating electronic control system 36 at block 230 can be detected by electronic control unit 38 or another computer in control system 36 and trigger, based on the activating of electronic control system 36, interrogation of a plurality of electronically controlled components installed in machine 12 by a computer of electronic control system 36 at a block 240.

Interrogating fuel injectors 28 could include commanding communication control unit 50, with electronic control unit 38, to commence serially interrogating fuel injectors 28 to machine read the electronic trim files each resident on fuel injectors 28. Responsive to one or more interrogation initiation commands from electronic control unit 38, communication control unit 50 could interrogate the fuel injector 28 at cylinder 1, then interrogate the fuel injector at cylinder 2, then at cylinder 3, and so on. Interrogating fuel injectors 28 could further include machine reading the unique component identifier stored on the machine readable storage medium 30 of each one of fuel injectors 28. From block 240 flowchart 200 can advance to a block 250 to transmit component identifiers and trim files over communication link 44 to a computer such as electronic control unit 38 in control system 36. Transmitting could include transmitting the data for each fuel injector one at a time, for instance, to communication control unit 50 which then communicates the data to electronic control unit 38. Instead of a wired communication link, it should be appreciated that a radio frequency (RF) communication link or some other wireless communication could instead be used. Communication link 40 could be integrated into the same wiring harness as control link 42.

From block 250, flowchart 200 can advance to a block 260 to populate trim table 82 on memory 78, or potentially on a different machine readable storage medium in control system 36. Populating trim table 82 can also include repopulating trim table 82 at each of a plurality of addresses 84 with the unique component identifier and electronic trim file for a different one of fuel injectors 28. It will be recalled that trim table 82 may be repopulated each time machine system 10 is turned on and control system 36 activated. Accordingly, previously stored trim files and component identifiers may be overwritten by way of the populating of trim table 82 that occurs at block 260. It will also be recalled that previously stored component identifiers and electronic trim files may be mis-matched in trim table 82 to fuel injectors 28. In other words, because some change such as varying a pattern of service locations of fuel injectors 28 or a composition of fuel injectors 28, between an earlier time of deactivating electronic control system 36 and a later time of activating electronic control system 36 may have occurred, mis-matching of electronic trim files and component identifiers is corrected. Servicing errors, including human or machine errors, in machine system 10 are expected to be reduced by way of the repopulating of trim table 82 in the described manner. From block 260 flowchart 200 can advance to block 270 to determine control signals for fuel injectors 28, and then to a block 280 to output the control signals each based on the corresponding one of the plurality of electronic trim files to each of fuel injectors 28. Flowchart 200 may then proceed to a block 300 to run machine system 10 after the populating of trim table 82 based on operation of fuel injectors 28 to inject fuel for combustion into cylinders 16 responsive to the outputted control signals.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of operating a machine system comprising:

activating an on-board electronic control system of a machine;

triggering, based on the activating of the on-board electronic control system, interrogation of a plurality of electronically controlled components installed in the machine by a computer of the on-board electronic control system;

machine reading, during the interrogation, a plurality of electronic trim files each resident on a different one of the plurality of electronically controlled components and a plurality of component identifiers each resident on a different one of the plurality of electronically controlled components;

comparing the plurality of component identifiers to previously stored component identifiers;

determining, based on the comparing the plurality of component identifiers to previously stored component identifiers, at least one of, swapping out of one of the plurality of electronically controlled components for a substitute, or a change to a service location in the machine system of one of the plurality of electronically controlled components;

populating a data structure on a machine readable storage medium in the on-board electronic control system with the plurality of electronic trim files and the plurality of component identifiers;

outputting control signals each based on the corresponding one of the plurality of electronic trim files to each of the plurality of electronically controlled components;

running the machine system after the populating of the data structure based on operation of the plurality of electronically controlled components responsive to the outputted control signals; and using the plurality of electronic trim files populating the data structure on the machine readable storage medium during the running of the machine system.

2. The method of claim 1 wherein the populating of the data structure further includes repopulating a trim table at each of a plurality of addresses with the component identifier and electronic trim file for a different one of the plurality of electronically controlled components.

3. The method of claim 2 wherein the plurality of electronically controlled components includes a plurality of fuel injectors and each of the plurality of addresses includes an address corresponding to a different one of a plurality of cylinders in an engine in the machine system.

4. The method of claim 3 wherein the outputting of control signals further includes outputting a control signal waveform to an electrical actuator in each of the plurality of fuel injectors that is based on the corresponding electronic trim file.

5. The method of claim 3 wherein the plurality of component identifiers and the plurality of electronic trim files are stored on machine readable storage mediums resident on the plurality of fuel injectors.

6. The method of claim 5 further comprising transmitting the plurality of component identifiers and the plurality of electronic trim files to a computer in the on-board electronic control system.

7. The method of claim 6 wherein the transmitting of the plurality of component identifiers and the plurality of electronic trim files includes transmitting using a single-wire communication link.

8. The method of claim 3 wherein the activating of the on-board electronic control system includes actuating an ignition switch for the engine, and further comprising varying at least one of a pattern of service locations of the plurality of fuel injectors or a composition of the plurality of fuel injectors between an earlier time of deactivating the on-board electronic control system and a later time of the activating of the on-board electronic control system.

9. The method of claim 3 wherein the repopulating of the data structure further includes overwriting previously stored component identifiers and electronic trim files that are mis-matched in the trim table to the plurality of fuel injectors.

10. A machine system comprising:

at least one computer including a processor and a machine readable controller storage medium storing a data structure;

a plurality of electronically controlled components structured for installation in a machine and each including a machine readable component storage medium storing a unique component identifier and a unique electronic trim file;

a communication link connecting the at least one computer and the plurality of electronically controlled components;

the at least one computer being structured to:

detect activation of an on-board electronic control system in the machine;

trigger, based on detecting the activation of the on-board electronic control system, interrogation of the plurality of electronically controlled components;

read, during the interrogation, each of the unique component identifiers and unique electronic trim files from the machine readable component storage mediums of the plurality of electronically controlled components;

populate the data structure with the unique component identifier and the unique electronic trim file of each of the plurality of electronically controlled components;

output control signals each based on the corresponding unique electronic trim file to each of the plurality of electronically controlled components; and run the machine system based on operation of the plurality of electronically controlled components responsive to the outputted control signals, and using the unique component identifiers and unique electronic trim files populating the data structure during the running of the machine system;

wherein the plurality of electronically controlled components are structured for interchangeable service in the machine system; and the at least one computer is further structured to:

compare a previously stored unique component identifier to a newly stored unique component identifier; and determine, based on the comparison, at least one of, a swapping out of one of the plurality of electronically controlled components for a substitute, or a change to a service location in the machine system of one of the plurality of electronically controlled components.

11. The machine system of claim 10 wherein the data structure includes a trim table including a plurality of addresses each corresponding to one of a plurality of different interchangeable service locations in the machine.

12. The machine system of claim 11 wherein the plurality of electronically controlled components includes a plurality of fuel injectors, and the plurality of different interchangeable service locations includes a plurality of different cylinders in an engine.

13. The machine system of claim 11 wherein the communication link includes a wired communication link having a plurality of nodes corresponding to the plurality of different interchangeable service locations.

14. The machine system of claim 11 wherein the unique electronic trim files each include a first electronic trim file for operating the corresponding one of the plurality of electronically controlled components at a first set of operating conditions of the machine system, and a second electronic trim file for operating the corresponding one of the plurality of electronically controlled components at a second set of operating conditions of the machine system.

15. The machine system of claim 10 wherein the plurality of electronically controlled components includes an electronically controlled pump.

16. A method of reducing servicing errors in a machine system comprising:

deactivating an electronic control system of a machine a first time;

activating the electronic control system a first time;

deactivating the electronic control system a second time;

activating the electronic control system a second time;

varying at least one of a pattern of service locations of the plurality of electronically controlled components or a composition of the plurality of electronically controlled components, between the deactivating of the electronic control system a first time and the activating of the electronic control system a first time;

performing, based on each of the activating of the electronic control system a first time and the activating of the electronic control system a second time, the operations:

triggering interrogation of a plurality of electronically controlled components installed in the machine by a computer of the electronic control system;

machine reading, during the interrogation, a plurality of electronic trim files each resident on a different one of the plurality of electronically controlled components and a plurality of component identifiers each resident on a different one of the plurality of electronically controlled components; and populating a data structure on a machine readable storage medium in the electronic control system with the plurality of electronic trim files and the plurality of component identifiers;

overwriting, by way of the populating of the data structure based on the activating of the electronic control system a first time, a plurality of previously stored electronic trim files mis-matched to the plurality of electronically controlled components;

overwriting, by way of the populating of the data structure based on the activating of the electronic control system a second time, a plurality of previously stored electronic trim files not mis-matched to the plurality of electronically controlled components;

outputting control signals based on the corresponding electronic trim file to each of the plurality of electronically controlled components; and operating the plurality of electronically controlled components responsive to the outputted control signals.

17. The method of claim 16 wherein the machine system includes an engine, and a fuel system for the engine where the plurality of electronically controlled components include a plurality of fuel injectors, and wherein the electronic control system includes an on-board electronic control system having an ignition switch that is actuated to activate the electronic control system.

18. The method of claim 16 wherein the overwriting, by way of the populating of the data structure based on the activating of the electronic control system a first time, further includes overwriting a previously stored electronic trim file for a first one of the plurality of electronically controlled components with a newly stored electronic trim file for a different one of the plurality of electronically controlled components or a substitute electronically controlled component.

* * * * *